US007432789B2

(12) United States Patent
Bärnklau et al.

(10) Patent No.: US 7,432,789 B2
(45) Date of Patent: Oct. 7, 2008

(54) ELECTROMAGNETIC SWITCHING DEVICE

(75) Inventors: Karl-Hans Bärnklau, Weiden (DE); Johann Drexler, Schwandorf (DE); Peter Hartinger, Bodenwöhr (DE); Gerhard Wössner, Amberg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/529,642

(22) PCT Filed: Aug. 27, 2003

(86) PCT No.: PCT/DE03/02577

§ 371 (c)(1),
(2), (4) Date: Jun. 13, 2006

(87) PCT Pub. No.: WO2004/032170

PCT Pub. Date: Apr. 15, 2004

(65) Prior Publication Data

US 2007/0139144 A1 Jun. 21, 2007

(30) Foreign Application Priority Data

Oct. 2, 2002 (DE) ..... 202 20 482 U

(51) Int. Cl.
*H01H 3/60* (2006.01)

(52) U.S. Cl. ..... 335/157; 335/132; 200/43.11; 200/50.02

(58) Field of Classification Search ..... 335/132, 335/157–158; 200/43.11, 50.02
See application file for complete search history.

(56) References Cited

U.S. PATENT DOCUMENTS

| | | | | |
|---|---|---|---|---|
| 3,745,492 | A | 7/1973 | Grunert | |
| 4,688,011 | A * | 8/1987 | Lemmer et al. | 335/159 |
| 5,844,186 | A | 12/1998 | Meriwether | |
| 6,642,820 | B2 * | 11/2003 | Emura et al. | 335/17 |
| 6,750,746 | B2 * | 6/2004 | Bauer et al. | 335/132 |

FOREIGN PATENT DOCUMENTS

| | | |
|---|---|---|
| JP | 8203407 A | 8/1996 |
| WO | WO 99/56295 | 11/1999 |

OTHER PUBLICATIONS

English language translation of Japanese Office Action issued in connection with corresponding Japanese Application No. 2004-540466 mailed Oct. 25, 2007.

* cited by examiner

*Primary Examiner*—Ramon M Barrera
(74) *Attorney, Agent, or Firm*—Harness, Dickey & Pierce P.L.C.

(57) ABSTRACT

An electromagnetic switching device includes an electromagnetic drive device and at least one electrical contact that, when a starting current is applied to the drive device, can be transferred by the drive device from a disconnect position (contact opened) into a bridging position (contact closed). When the switching device is fully installed, the contact can be blocked in the disconnect position and can be mechanically blocked in the disconnect position by an arresting element that can be connected to the switching device. As a result, the contact remains in the disconnect position even when the starting current is applied to the drive device.

15 Claims, 2 Drawing Sheets

ELECTROMAGNETIC SWITCHING DEVICE

This application is the national phase under 35 U.S.C. § 371 of PCT International Application No. PCT/DE2003/002577 which has an International filing date of Aug. 27, 2003, which designated the United States of America and which claims priority on German Patent Application number DE 202 20 482.0 filed Oct. 2, 2002, the entire contents of which are hereby incorporated herein by reference.

FIELD OF THE INVENTION

The present invention generally relates to an electromagnetic switching device. In particular, it relates to a contactor, having an electromagnetic drive apparatus and having at least one electrical contact, in which case the contact can be moved by a contact link support from a disconnected position to a bridging position by the electromagnetic drive apparatus when a pull-in current is applied to the electromagnetic drive apparatus, with the contact being closed in the bridging position and being open in the disconnected position.

BACKGROUND OF THE INVENTION

Switching devices are generally known. Merely by way of example, reference is made to U.S. Pat. Nos. 3,745,492, 5,844,186 and WO 99/56295 A1.

In order to ensure that electrical systems are not live while work is being carried out on or in these systems, main switches and switching devices with disconnector characteristics are specified. On the one hand, these must reliably signal, either by way of a visible disconnection gap or by an indication which reliably indicates the switching state of the device, the disconnection of the system from the supply. In particular, however, they must allow blocking which reliably prevents accidental connection. Furthermore, the switching point must reliably withstand an increased voltage. Furthermore, predetermined creepage currents must not be exceeded.

Devices of this type are described, for example, in IEC 60947-2 and IEC 60947-3. These Standards are implemented in electrical devices such as disconnectors, load disconnectors, safety load disconnectors and circuit breakers with a disconnection function, and similar devices.

Electromagnetic switching devices according to the prior art as cited above satisfy these requirements.

SUMMARY OF THE INVENTION

An object of an embodiment of the present invention is to provide a further electromagnetic switching device of the generic type.

An object may be achieved in that the electromagnetic switching device may have a basic appliance and an additional appliance which is connected to the basic appliance, and/or in that the contact link support and the contact may be arranged in the basic appliance, and/or in that the additional appliance may have an extension which is connected to the contact link support in such a way that the extension is positively guided by the contact link support, and/or in that the extension can be mechanically blocked by use of a locking element which can be connected to the additional appliance and can be blocked in the disconnected position of the contact, such that the extension and, with it, the contact link support and the contact as well is locked in the disconnected position even when the pull-in current is applied to the electromagnetic drive apparatus.

If the contact can be blocked in a locking element holder by the insertion of the locking element, the switching device may have a particularly simple physical design. The locking element holder may in this case alternatively be open on both sides or on only one side.

If the locking element is held captive in the additional appliance, no separate element is required for blocking the contact. Furthermore, in this case, the locking element may be matched to the additional appliance, in particular to any locking element holder. Tolerances are therefore known in advance, and can be minimized.

If the additional device has an additional switch which can be connected in a circuit via which the pull-in current can be applied to the electromagnetic drive apparatus, a power supply for the electromagnetic drive apparatus can be interrupted at the switching device.

If the additional switch is arranged and designed such that it is opened when the contact is mechanically blocked, it is not possible for opening of the coil circuit to be accidentally prevented.

The connection between the additional appliance and the basic appliance may alternatively be detachable or non-detachable. At least when the contact is mechanically blocked in the disconnected position, the additional appliance should, however, be connected non-detachably to the basic appliance.

The connection between the basic appliance and the additional appliance is particularly simple if the additional appliance is latched to the basic appliance.

As a result of the configuration of the basic appliance, the additional appliance should be adjacent to the basic appliance on an appliance side which runs at right angles to a movement direction of the contact link support.

If the switching device can be connected to an auxiliary switch housing, in which an auxiliary switch may be arranged which can be operated by the contact link support together with the contact, the switching device can be used more flexibly. The auxiliary switch is in this case preferably connected to the contact link support without any play. However, alternatively, the connection may be direct or indirect.

BRIEF DESCRIPTION OF THE DRAWINGS

Further advantages and details will become evident from the following description of example embodiments in conjunction with the drawings in which, illustrated in outline form.

DETAILED DESCRIPTION OF THE EXAMPLE EMBODIMENTS

Figure 2:
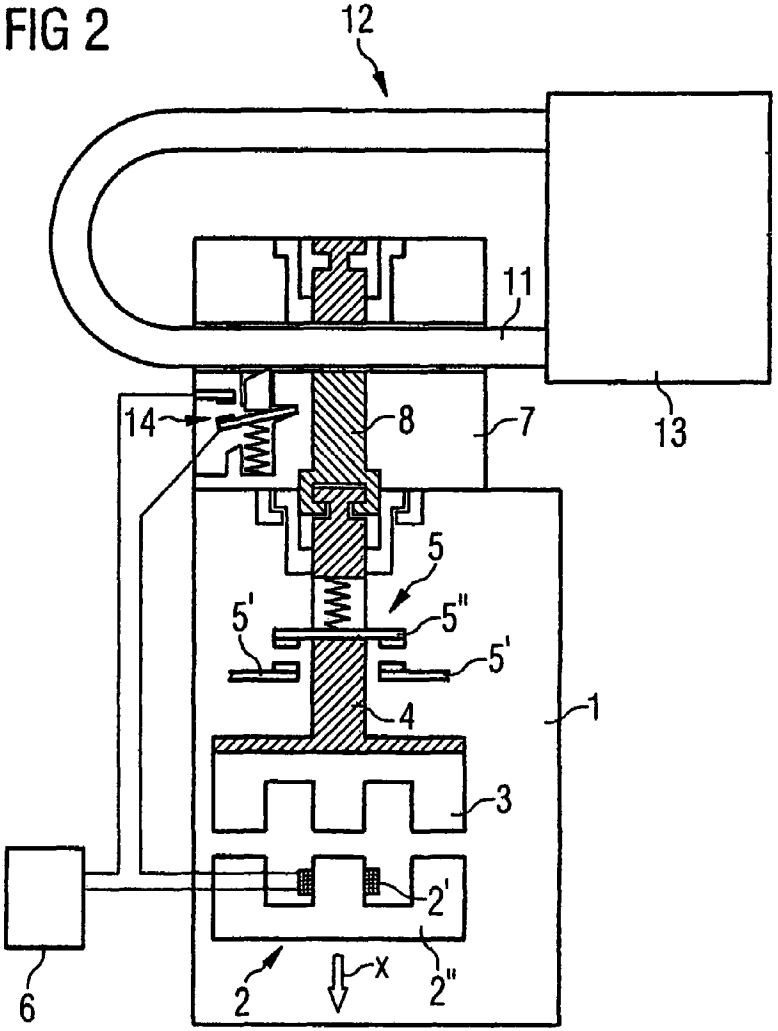
FIGS. 2 and 3 show modifications of FIG. 1.
Figure 1:
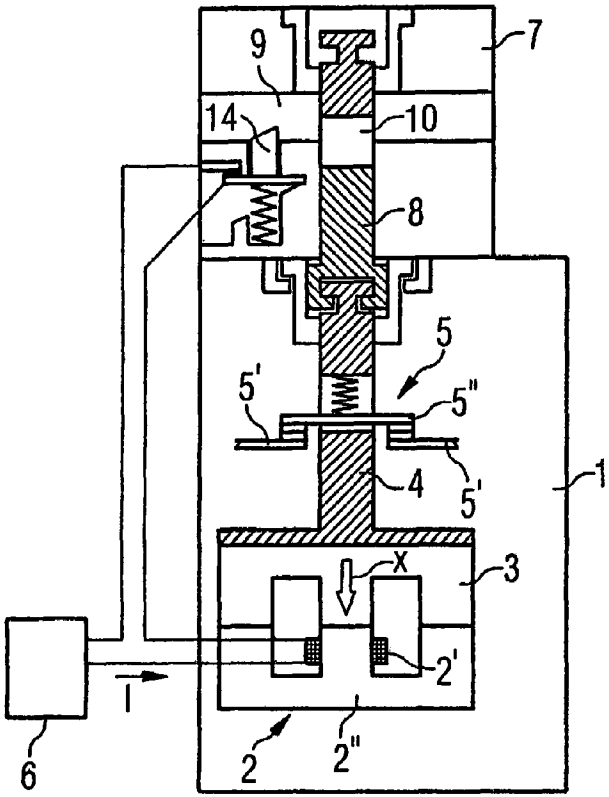
FIG. 1 shows a section through an electromagnetic switching device.

FIGS. 1 and 2 show a basic appliance 1 of an electromagnetic switching device in the form of a contactor, by way of example. The contactor has, inter alia, an electromagnetic drive apparatus 2, an armature 3, a contact link support 4 and, generally two or more, electrical contacts 5. For the sake of clarity, only one contact 5 is in this case illustrated in FIGS. 1 and 2. Each contact 5 generally comprises two stationary contact points 5' and one moving contact link 5".

The electromagnetic drive apparatus 2 has a coil 2' and a coil core 2". A pull-in current I can be applied to the coil 2' via a drive unit 6. In this case, the armature 3 is pulled in, thus moving the contact link support 4, and, with it, the contact link 5" to a bridging position in which the contact 5 is closed. This state is illustrated in FIG. 1.

When, on the other hand, no pull-in current I is applied to the coil 2", the contact link support 4 and, with it, the contact link 5" are moved by way of a return spring to a disconnected position. In this position, the contact 5 is open. This position is illustrated in FIG. 2. The return spring is not illustrated in this case, for the sake of clarity.

During the movement from the disconnected position to the bridging position, and vice versa, the contact link support 4 is moved in a movement direction x. As can be seen from FIGS. 1 and 2, an additional appliance 7 is adjacent to the basic appliance 1. The additional appliance 7 is in this case adjacent to the basic appliance 1 on an appliance side which runs at right angles to the movement direction x.

The additional appliance 7 is likewise a component of the electromagnetic switching device, and is connected, for example latched, to the basic appliance 1. The additional appliance 7 has an extension 8 for the contact link support 4. The extension 8 is connected to the contact link support 4—preferably without any play—so that the extension 8 is positively guided by the contact link support 4.

The additional appliance 7 has a locking element holder 9 which is continuous, that is to say it is open on both sides, and the extension 8 has a corresponding recess 10. When the contact link support 4—and with it the contact 5—is in the disconnected position, a locking element 11 can thus, as is shown in FIG. 2, be guided manually through the locking element holder 9—in this case, for example, the shackle 11 of a padlock 12.

The locking element 11 is thus connected to the additional appliance 7 (and to the switching device), such that it is blocked in the disconnected position of the contact link support 4, by operation of a blocking element 13, in this case the closing element 13 of the padlock 12. When the locking element 11 is in the locking element holder 9, the extension 8 and, with it, the contact link support 4 and the contact 5 as well are mechanically blocked in the disconnected position.

These elements 4, 5, 8 are thus locked in the disconnected position even when the pull-in current I is applied to the electromagnetic drive apparatus 2. As can be seen, the locking element 11 can in this case be inserted into the locking element holder 9 when the switching device is completely installed.

It is possible for the connection of the additional appliance 7 to the basic appliance 1 to be detachable. However, it is preferably non-detachable, at least when the contact 5 is mechanically blocked in the disconnected position. Generally, it is even advantageous for the additional appliance 7 to be permanently and non-detachably connected to the basic appliance 1.

As can be seen from FIGS. 1 and 2, the switching device has an additional switch 14, which is arranged in the additional appliance 7. As can be seen from FIGS. 1 and 2, the additional switch 14 is connected in a circuit via which the pull-in current I can be applied to the electromagnetic drive apparatus 2. As can also be seen, it is arranged and designed in such a manner that it interrupts the circuit when the locking element 11 is inserted into the locking element holder 9, that is to say when the contact 5 is mechanically blocked.

It is therefore impossible to accidentally connect the electromagnetic drive apparatus 2 when the contact link support 4 is blocked. This therefore avoids any possible damage resulting from a high current load on the coil 2' lasting for an excessively long time.

Figure 4:
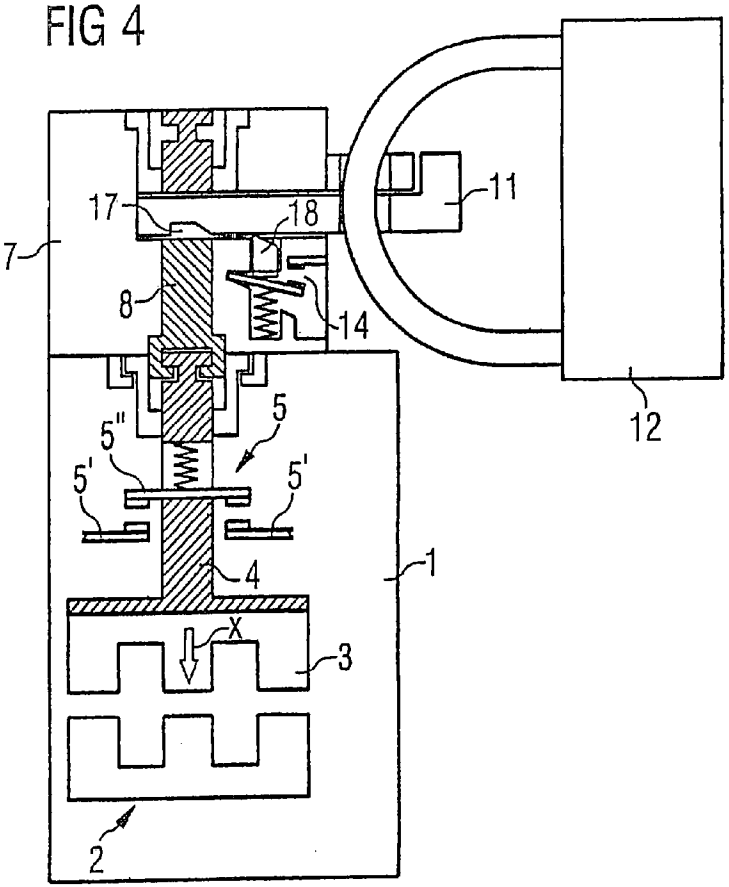
FIG. 4 shows a section through a further electromagnetic switching device.
Figure 3:
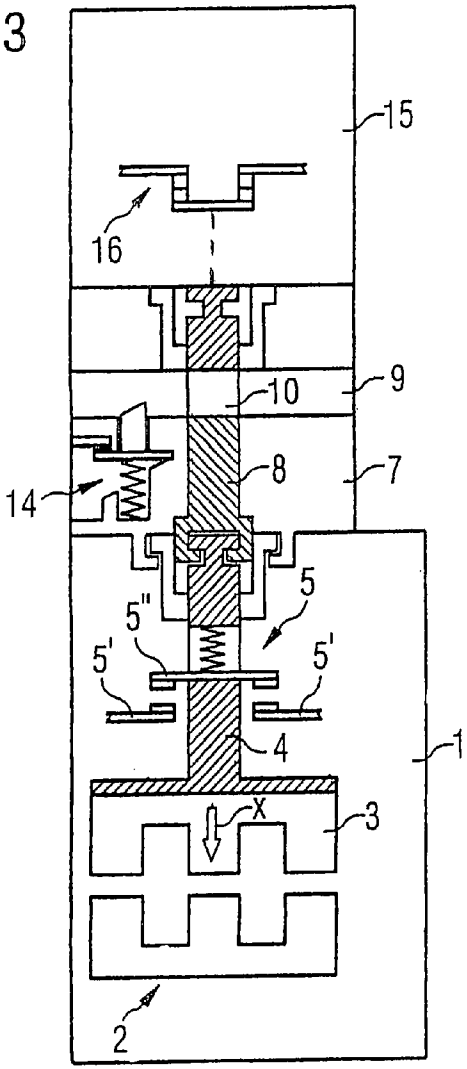

The embodiments shown in FIGS. 3 and 4 correspond essentially to the embodiment shown in FIGS. 1 and 2. As can be seen from FIG. 3, however, an auxiliary switch housing 15 is fitted to the additional appliance 7 on a side opposite the basic appliance 1, and is connected to the additional appliance 7.

By way of example, the auxiliary switch housing 15 may be latched to the additional appliance 7. An auxiliary switch 16 is arranged in the auxiliary switch housing 15. The auxiliary switch 16 is operated by the contact link support 4 together with the contact 5.

Owing to the subdivision of the switching device into the basic appliance 1 and the additional appliance 7, the auxiliary switch 16 can be operated by the contact link support 4 only via the extension 8, and thus indirectly. In addition, direct operation would also be possible with a corresponding integral configuration of the switching device. In any case, however, the auxiliary switch 16 should be operable by the contact link support 4 without any play.

In the embodiment shown in FIG. 4—and in contrast to FIGS. 1 and 3—the locking element holder 9 is open on only one side. Furthermore, the locking element 11 is permanently connected to the additional appliance 7 in the embodiment shown in FIG. 4. For this purpose, the locking element 11 and the locking element holder 9 have interacting holding and latching elements 17, 18, by way of which the locking element 11 is held captive in the additional appliance 7.

As can be seen from FIG. 4, one of the holding and latching elements 17, 18 corresponds to an operating member for the additional switch 14. The operating member for the additional switch 14 could, however, also be a separate element.

The refinement of the electromagnetic switching device according to an embodiment of the invention thus allows disconnector characteristics to be added to the electromagnetic switching device in a simple manner.

Exemplary embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. An electromagnetic switching device, comprising:

an electromagnetic drive apparatus;

at least one electrical contact, the contact being movable via a contact link support from a disconnected position to a bridging position by the electromagnetic drive apparatus when a pull-in current is applied to the electromagnetic drive apparatus, the contact being closed in the bridging position and being open in the disconnected position;

a basic appliance; and an additional appliance, connected to the basic appliance, the contact link support and the at least one contact being arranged in the basic appliance, the additional appliance including, an extension, connected to the contact link support in such a way that the extension is positively guided by the contact link support, the extension being mechanically blockable by use of a locking element, connectable to the additional appliance and blockable in the disconnected position of the contact, such that the extension, the contact link support and the contact are locked in the disconnected position, even when the pull-in current is applied to the electromagnetic drive apparatus.

2. The switching device as claimed in claim 1, wherein the additional appliance includes a locking element holder and the contact is blockable in the locking element holder by insertion of the locking element.

3. The switching device as claimed in claim 2, wherein the locking element holder has parallel sides that are open on both sides to receive the locking element.

4. The switching device as claimed in claim 2, wherein the locking element holder has parallel sides and is open on only one side.

5. The switching device as claimed in claim 1, wherein the locking element is held captive in the additional appliance.

6. The switching device as claimed in claim 1, wherein the additional appliance has an additional switch connectable in a circuit via which the pull-in current is appliable to the electromagnetic drive apparatus.

7. The switching device as claimed in claim 6, wherein the additional switch is arranged and designed such that it is opened when the contact is mechanically blocked.

8. The switching device as claimed in claim 1, wherein the additional appliance is connected to the basic appliance, non-detachably, at least when the contact is mechanically blocked in the disconnected position.

9. The switching device as claimed in claim 1, wherein the additional appliance is latched to the basic appliance.

10. The switching device as claimed in claim 1, wherein the additional appliance is adjacent to the basic appliance on an appliance side which runs at right angles to a movement direction of the contact link support.

11. The switching device as claimed in claim 1, wherein an auxiliary switch housing is connectable to the switching device and includes an auxiliary switch arranged in it, operatable by the contact link support together with the contact.

12. The switching device as claimed in claim 11, wherein the auxiliary switch is operatable, directly or indirectly, by the contact link support without any play.

13. The switching device as claimed in claim 1, wherein the electromagnetic switching device is a contactor.

14. The switching device as claimed in claim 1, wherein the extension is arranged within the additional appliance when not mechanically blocked by the locking element.

15. An additional appliance for an electromagnetic switching device, said additional appliance being connectable to a basic appliance of the electromagnetic switching device, wherein:

said basic appliance has an electromagnetic drive apparatus and a contact link support;

said contact link support is movable from a first position to a second position by applying a pull-in current to the electromagnetic drive apparatus;

said additional appliance has an extension which is connectable to the contact link support of the basic appliance in such a way that the extension is positively guided by the contact link support;

said extension is mechanically blockable by a locking element that is insertable into the additional appliance when said contact link support is in the first position; and said contact link support remains in the first position even when the pull-in current is applied to the electromagnetic drive apparatus when the locking element is inserted into the additional appliance.

* * * * *